United States Patent [19]

Mueller

[11] 4,045,756

[45] Aug. 30, 1977

[54] SEGMENTED EXPANSION ABSORBER FOR LIFTING MAGNET

[75] Inventor: Armand G. Mueller, Elm Grove, Wis.

[73] Assignee: Square D Company, Park Ridge, Ill.

[21] Appl. No.: 704,907

[22] Filed: July 13, 1976

[51] Int. Cl.[2] ..... H01F 7/20

[52] U.S. Cl. ..... 335/292; 335/294

[58] Field of Search ..... 335/289, 291, 292, 294, 335/300

[56] References Cited

U.S. PATENT DOCUMENTS

| | | | |
|---|---|---|---|
| 3,693,126 | 9/1972 | Rybak | 335/291 |
| 3,763,453 | 10/1973 | Schurr | 335/292 |

*Primary Examiner*—George Harris

*Attorney, Agent, or Firm*—William H. Schmeling; Richard L. Guttman

[57] ABSTRACT

A lifting magnet has lengths of sealed plastic tubing positioned circumferentially of its coil prior to its encapsulation in a magnet case. The tubing is hermetically sealed every few inches along its entire length in order to divide the tubing into individually sealed segments. The sealed segments form compressible air spaces at the outer periphery of the magnet coil which permit thermal expansion of the coil and the encapsulating material without substantial force being applied by the coil and the encapsulating material to the magnet case. In the event any one or a few segments of the tubing are perforated or otherwise disabled in the course of fabrication or assembly of the magnet, the balance of the sealed segments still serve their intended purpose.

6 Claims, 3 Drawing Figures

FIG. 1
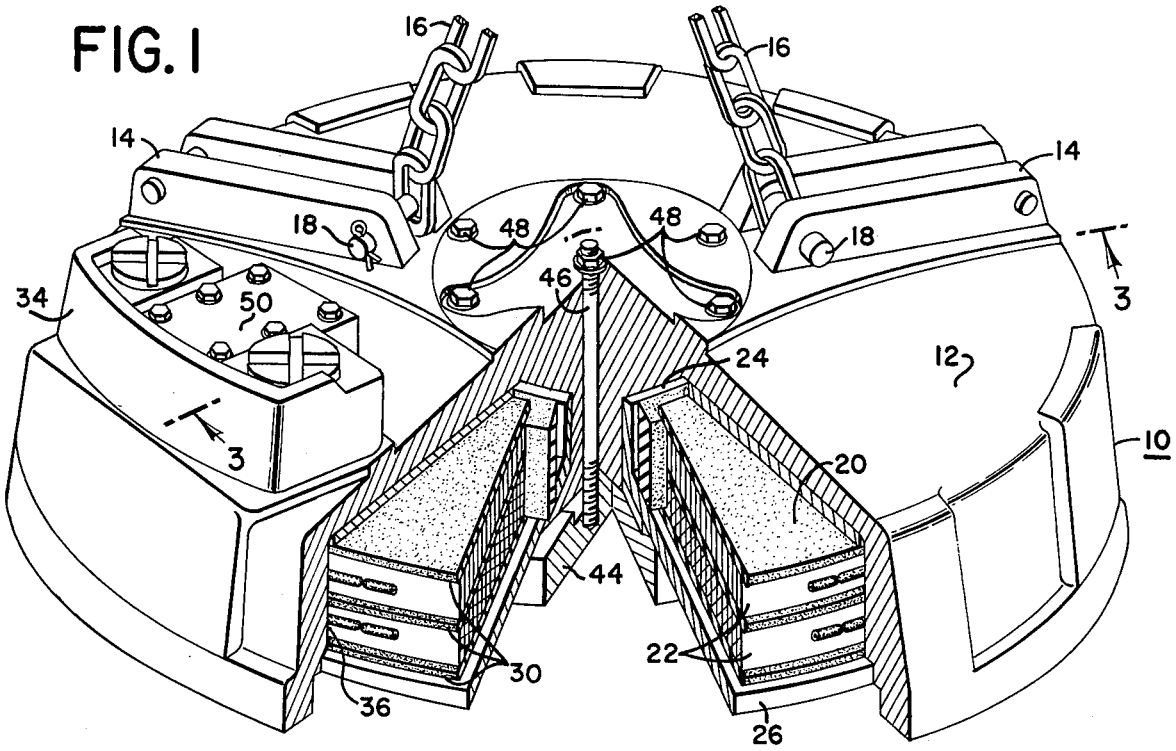
FIG. 2
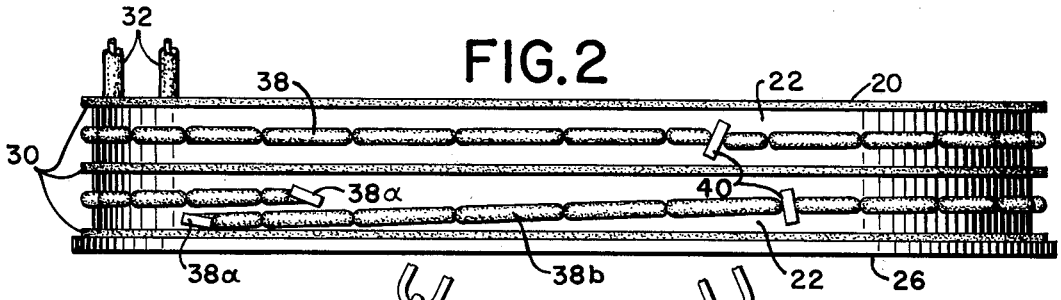
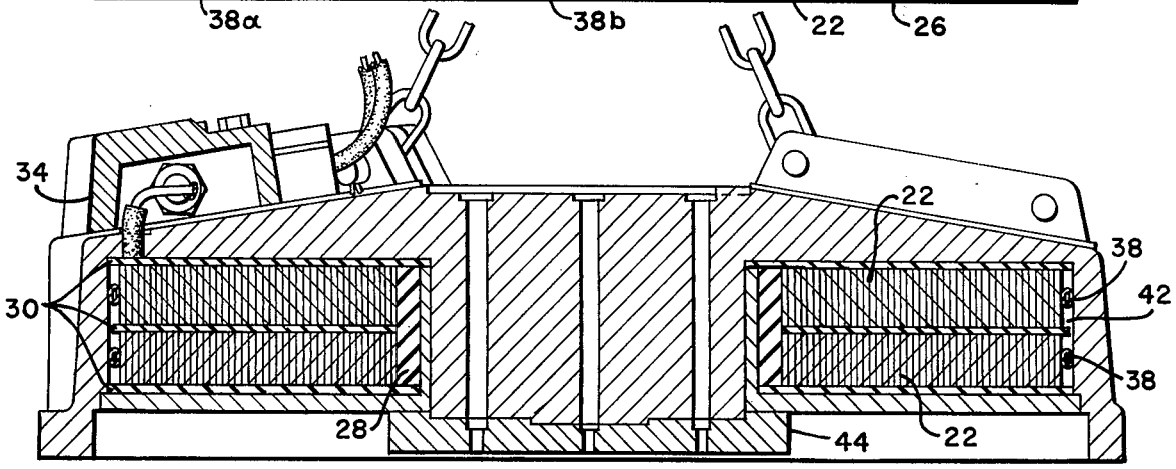
FIG. 3

SEGMENTED EXPANSION ABSORBER FOR LIFTING MAGNET

BACKGROUND OF THE INVENTION

This invention relates to lifting magnets and, more particularly, to an improved means for protecting component parts of a lifting magnet from cracking, buckling, or otherwise being damaged due to internal stress resulting from thermal expansion of the lifting magnet and its encapsulating material.

One solution for solving the thermal expansion problem is shown in U.S. Pat. No. 3,763,453 which issued on Oct. 2, 1973. In this patent, a hermetically sealed tubing is wound around the magnet coil and secured in place by taping it to the coil before the coil is encapsulated in the encapsulating material or potting compound in a manner known in the art. This tubing is flexible and compressible and absorbs the thermal expansion of the coil and its encapsulating material during the operation of the lifting magnet to prevent cracking of the magnet case. However, the use of a single sealed tubing has several problems and one of these problems is that if any portion of the tubing is perforated in the course of fabrication or assembly of the coil and magnet, or during encapsulation, the entire tubing becomes inoperative.

SUMMARY OF THE INVENTION

With this invention the foregoing problem is solved by providing a compartmentalized sealed tubing fixed to the periphery of the magnet coil. Each sealed compartment or segment of the tubing is independent from the other and thus the segmented tubing provides a plurality of separate air spaces around the coil each of which can be compressed as the coil and potting compound expand with rising temperatures. If any one or a few segments of the tubing are perforated or have their seal damaged in the fabrication or assembly of the coil and magnet or later during the encapsulation state, then the remaining segments of the tubing still serve their intended purpose of providing a compressible air space to compensate for the thermal expansion of the lifting magnet coil and the encapsulating material so that the above expansion does not crack the magnet case.

In accordance with the present invention, the hermetic tubing is sealed every six to eight inches along its entire length in order to provide the desired number of sealed compartments or segments with the proper air space to accommodate the anticipated expansion of the magnet coil and its encapsulating material. This arrangement provides a wide margin for errors in the course of manufacturing and assembling the magnet and coil in which up to 30% of the tubing segments per coil can be perforated before the tubing becomes inoperative in establishing the necessary air gaps. As a result, the quality control costs and the magnet failures are sharply reduced by this invention.

BRIEF DESCRIPTION OF THE DRAWINGS

Other objects and advantages will become apparent from the following description wherein reference is made to the accompanying drawings illustrating a preferred embodiment of the invention and in which:

FIG. 1 is a partially sectioned perspective view of a lifting magnet incorporating a segmented thermal expansion absorbing means in accordance with this invention;

FIG. 2 is a side view of a magnetic coil assembly of FIG. 1 wrapped with the hermetically sealed tubing in accordance with this invention; and FIG. 3 is a cross-sectional view taken along the line 3—3 of FIG. 1.

DESCRIPTION OF THE PREFERRED EMBODIMENT

The preferred embodiment of a segmented thermal expansion absorber for lifting magnets in accordance with the present invention is illustrated in FIGS. 1-3 in connection with a circular lifting magnet 10 having a steel magnet case 12. Circumferentially spaces lugs 14 are formed on top of the magnet case 12 for attachment of hoisting chains 16 by means of pins 18.

Within the case 12 is a magnet coil assembly 20 comprising a plurality of coils 22 of copper or aluminum strip of a predetermined width wound in stacked relation on a hub portion 24 of a bottom plate 26 of the magnet 10. Suitable electrical insulation 28 is provided between the hub portion 24 and the coils 22, and insulation is provided between successive turns of the coils in a manner well known to those skilled in the art. Insulating discs 30 electrically isolate the coils 22 from the magnet case 12, from the bottom plate 26, and from each other. A pair of conductors 32 electrically connects the coils 22 to a direct current source (not shown) externally of the magnet 10 through a terminal box 34 of the magnet case 12. The coils 22 are generally serially electrically connected to each other.

Prior to the insertion of the magnet coil assembly 20 into a cavity 36 formed within the magnet case 12, one or more lengths of the hermetically sealed tubing 38 are wrapped around, and attached to, the outer peripheral surface of each coil 22. This tubing 38 may be of any suitable material which is chemically compatible with the potting compound encapsulating the coils. For example, in the preferred embodiment, the tubing 38 is formed of a polyester film with a one inch outer diameter and a 0.010 inch wall thickness. Tubing of this nature is readily and commercially available in any desired precut lengths and suitable lengths are attached to the coils 22 by any convenient means, such as by pieces of chemically compatible adhesive tape 40.

Before being assembled on the coils 22, the tubing 38 is preferably sealed by a heat weld at its ends **38*a* and at approximately every 6 to 8 inches along its entire length of approximately 6 to 7 feet depending upon design considerations in order to divide the tubing 38 into individually sealed compartments or segments 38*b*. The sealed segments 38*b* form compressible air spaces at the outer periphery of the magnet coil which permit thermal expansion of the coil and its encapsulating material without substantial force being applied through the encapsulating material to the magnet case. Although the tubing 38 places air spaces at or near the surface of the magnet coils 22, adequate and even dissipation of heat through the encapsulating material is assured because the location and size of the air spaces are controlled so that at least a substantial portion of the outer surface of each magnet coil 22 remains in contact with encapsulating material and a sufficient heat dissipation path to the magnet case 12 is maintained. The number of segments 38*b* of the segmented tubing 38 which will provide the proper air spaces to accommodate the anticipated expansion of the aluminum or copper coils 22 over their operating temperature range can be readily ascertained. Lengths of tubing 38** having more than this number of segments are attached to the coil.

The use of segmented tubing 38 in which each segment **38*b* is sealed individually from the remaining segments overcomes the problems of previous tubing, sealed only at each end, which when any portion of this latter tubing was ruptured, the entire tubing becomes inoperative. Segmented tubing 38 with its individually sealed compartments is effective against inadvertant damage to the tubing in the course of fabrication or assembly of the coil and magnet or in the event of damage to the tubing before the potting compound 42, such as epoxy and tung oil, hardened by polymerizing establishes the proper air gaps. Now, if any one or three to four segments 38*b*** in a tubing six to 7 feet in length are ruptured or their seal damaged, it will not render the entire tubing inoperative. This built-in safety factor of approximately 30% of the segments being disabled before the tubing becomes inoperative means a substantial savings in quality control costs as well as a reduction in number of coil failures.

The assembled magnet coil assembly 20, with the lengths of segmented tubing 38 attached, is fitted into the magnet case 12 and the magnet is sealed by welding the perimeter of the bottom plate 26 to the magnet case 12. A center pole shoe 44 is attached at the bottom of the magnet by releasable fasteners such as bolts 46 and corresponding nuts 48. The conductors 32 are passed through the terminal box 34 for external connection and the magnet is encapsulated by filling the magnet cavity 36 with the potting compound material 42, such as the previously mentioned epoxy and tung oil, through any convenient opening in the magnet case 12 such as the terminal box 34, until the interior cavity of the magnet is filled and no voids remain except those controlled air spaces within the segmented lengths of tubing 38 which have not been punctured during assembly. After encapsulation, the terminal box 34 is closed by a cover plate 50.

During operation of the lifting magnet, a direct current source sends an electric current of relatively large magnitude through the coils 22 to produce a magnetic field for lifting scrap, or other forms of magnetizable material. This magnetizing current heats the magnet coil 22, causing it to expand. The amount of radial expansion depends upon the increase in temperature which in turn is related to the duty cycle of the magnet. Without the lengths of segmented tubing 38 in place, the expanding copper or aluminum magnet coils 22 apply an outward force to the encapsulating material 42, which, due to the lesser rate of expansion of the steel magnet case 12, causes the encapsulating material to be compressed and creates high magnitude forces within the magnet case 12. With continued heating of the magnet coils 22, the compressive forces applied to and by the encapsulating material 42 are greatly increased. These forces may cause a break in the weld or, in the case of the bolted magnets, a seal between the bottom plate 26 and the magnet case 12. This may cause moisture to be drawn into the magnet cavity, as the magnet heating and cooling acts like a diaphragm and such moisture causes insulation failure as is well known to those skilled in the art.

This problem is eliminated by the use of the segmented lengths of tubing 38 which provide air gaps in the encapsulating material 42 near the outer surface of the magnet coils 22 and permit the coil to expand with the heating so that the compression of the encapsulating material 42 and the forces associated therewith are prevented. In the normal course of fabrication and assembly of the magnet and coil and during the encapsulation process, inadvertent perforations of the tubing used to provide the required air gaps often takes place. Now, with the segmented tubing of the present invention, up to 30% of the tubing per coil can be perforated before the tubing is inoperative in establishing the required air gaps until the potting compound hardens.

Having thus described my invention, I claim:

1. A lifting magnet, comprising: a magnet case having a sealed cavity; a magnet coil mounted within the cavity; potting compound encapsulating the magnet coil and substantially filling any remaining voids in the cavity; and means for absorbing the compressive forces acting upon the encapsulating compound due to expansion of the magnet coil during its operation, said means comprising individual hermetically sealed compartments serially connected to each other and each containing a predetermined volume of compressible fluid generally arranged and disposed to substantially surround the coil in order to provide a predetermined number of compartments, if none are punctured, providing a volume of compressible fluid in excess of said predetermined volume, whereby some segments can be disabled in the course of fabrication, assembly and encapsulation of the magnet and coil without rendering the entire absorbing means inoperative.

2. A lifting magnet according to claim 1 wherein said compartments comprise one or more flexible tubings, depending upon design considerations, having heat welds spaced at predetermined intervals along their entire length in order to form the individually sealed compartments.

3. A lifting magnet according to claim 2 wherein said flexible tubing has approximately a one inch outer diameter and a 0.010 inch wall thickness.

4. A lifting magnet according to claim 1 further including means attaching said absorbing means to the peripheral surface of the magnet coil.

5. A lifting magnet according to claim 1 wherein said compartments comprise a flexible length of tubing having hermetically sealed ends and segments forming compartments which are spaced every six to eight inches along its entire length.

6. A lifting magnet according to claim 1 wherein the magnet coil has an outer periphery of a predetermined width and the absorbing means comprises a flexible tubing having a diameter less than said predetermined width so that at least a substantial portion of the outer surface of the magnet coil remains in contact with the encapsulating compound and a sufficient heat dissipation path to the magnet case is maintained.

* * * * *